US005814941A

United States Patent [19]

Chen

[11] Patent Number: 5,814,941

[45] Date of Patent: Sep. 29, 1998

[54] DEVICE FOR ELIMINATING LOW FREQUENCY RADIATION OF MONITOR

[75] Inventor: Teng-Feng Chen, Ping Chen, Taiwan

[73] Assignee: MAG Technology Co., Ltd., Taipei, Taiwan

[21] Appl. No.: 802,066

[22] Filed: Feb. 19, 1997

[51] Int. Cl.[6] ..... H01J 29/06

[52] U.S. Cl. ..... 315/85; 348/819

[58] Field of Search ..... 315/8, 85; 348/819, 348/820

[56] References Cited

U.S. PATENT DOCUMENTS 5,066,891 11/1991 Harrold et al. ..... 315/8
5,151,635 9/1992 Cappels ..... 315/8 X
5,534,756 7/1996 Beeteson et al. ..... 315/8 X

*Primary Examiner*—Robert J. Pascal
*Assistant Examiner*—Justin P. Bettendorf
*Attorney, Agent, or Firm*—Ostrolenk, Faber, Gerb & Soffen, LLP

[57] ABSTRACT

A device for eliminating low frequency radiation of a computer monitor is disclosed, including a pair of first conductive plates disposed on two opposite sides of a cathode ray tube of the monitor to generate a radiation signal thereon that is induced by the low frequency radiation of the monitor, the radiation signal being applied to a circuit which amplifies and inverts the radiation signal to generate an in inverted and amplified output signal, the output signal being applied to a pair of second conductive plates arranged on another two opposite sides of the cathode ray tube to cancel the low frequency radiation of the cathode ray tube.

5 Claims, 8 Drawing Sheets

DEVICE FOR ELIMINATING LOW FREQUENCY RADIATION OF MONITOR

FIELD OF THE INVENTION

The present invention relates generally to computer monitor and in particular to a device for eliminating the low frequency radiation emitting from an operating computer monitor.

BACKGROUND OF THE INVENTION

Computer systems have been widely used nowadays. Monitors for displaying the operation and status of the computer systems usually comprise a cathode ray tube which emits an electron beam to a screen and shows an image thereon. The operation of the cathode ray tube gives off electromagnetic radiation, especially low frequency radiation, which may cause physical damage to the computer operators for a long term operation of the monitor.

Most of the developed countries have regulations to limit the electromagnetic radiation emitted from an operating monitor, such as TCO (The Swedish Confederation of Professional Employees) regulation. In accordance with the TCO regulation, the low frequency radiation of a computer monitor is measured by placing a detector 10 at a distance of 30 cm away from the front surface or screen 12 of the monitor 11 (see FIG. 1 of the attached drawings) and the measured radiation should be limited within 1 V/m.

One of the conventionally ways to reduce the low frequency radiation of the computer monitor is to use a cathode ray tube with lower surface impedance and to ground the surface of the cathode ray tube. Such a method, however, needs to generate negative pulses from a high voltage transformer to cancel the surrounding magnetic field. This is complicated and expensive.

Further, the low frequency radiation emitted from the cathode ray tube includes a vertical frequency of 50–100 Hz and a horizontal frequency of 24–80 Khz. Such a conventional way is only capable to reduce or suppress the horizontal frequency and can not solve the low frequency radiation problem of the computer monitor completely.

Another conventional way to handle such a low frequency radiation problem is to provide a coating on the monitor screen which is capable to resist or block the low frequency radiation. The application of the coating, however, is difficult for such a coating usually contains environmental pollution material or toxicant material.

Thus it is desirable to provide a device to overcome or eliminate the low frequency radiation problem encountered in the computer monitor art.

SUMMARY OF THE INVENTION

The principal object of the present invention is to provide a device to eliminate the low frequency radiation generated by an operating computer monitor which does not include a low surface impedance cathode ray tube or does not made use of any environmental pollution material coating on the monitor screen.

Another object of the present invention is to provide a device which is capable of substantially completely eliminating the low frequency radiation generated in an operating monitor.

A further object of the present invention is to provide a device for eliminating the low frequency radiation of a monitor which is completely enclosed inside the monitor casing so as not to affect to any extent the outside configuration of the monitor.

In accordance with the present invention, there is provided a device for eliminating low frequency radiation of a computer monitor, comprising a pair of first conductive plates disposed on two opposite sides of a cathode ray tube of the monitor to generate a radiation signal thereon that is induced by the low frequency radiation of the monitor, the radiation signal being applied to a circuit which amplifies and inverts the radiation signal to generate an inverted and amplified output signal, the output signal being applied to a pair of second conductive plates arranged on another two opposite sides of the cathode ray tube to cancel the low frequency radiation of the cathode ray tube.

In accordance with an aspect of the present invention, the first conductive plates are disposed on side edge portions of the monitor screen and the second conductive plates are arranged on different side edge portions of the monitor screen.

In accordance with another aspect of the present invention, the first conductive plates are disposed on side edge portions of the monitor screen while the second conductive plates are arranged on top and bottom sides of the cathode ray tube.

BRIEF DESCRIPTION OF THE DRAWINGS

The present invention will be better understood from the following description of preferred embodiments thereof, with reference to the attached drawings, wherein.

DETAILED DESCRIPTION OF THE PREFERRED EMBODIMENTS

Figure 2:
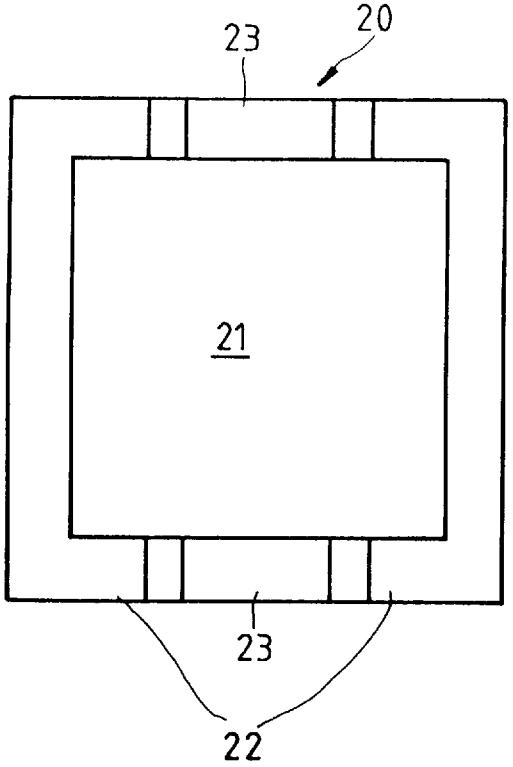
FIG. 2 is a schematic view showing a low frequency radiation eliminating device in accordance with a first embodiment of the present invention, mounted on a cathode ray tube of a computer monitor.

With reference to the drawings and in particular to FIG. 2, which shows a schematic front view of a computer monitor with a low frequency radiation eliminating device constructed in accordance with a first embodiment of the present invention mounted thereon, the low frequency radiation eliminating device of the present invention comprises a pair of first conductive plates 22, preferably made of copper- or iron-based alloys, disposed on two opposite side edge portions of the screen of the cathode ray tube designated at 21. The first plates 22 are to receive the radiation generated during the operation of the computer monitor and in response thereto to generate a signal induced on the first plates 22 to be applied to a circuit to be described later. The circuit receives the signal and then inverts and amplifies the signal. The inverted and amplified signal is then applied to a pair of second conductive plates 23, preferably made of a copper- or iron-based alloy, disposed on the other two opposite side edge portions of the screen of the cathode ray tube 21 to cancel the radiation generated by the cathode ray tube 21.

In accordance with the present invention, preferably the first plates 22 have a size larger than the second plates 23.

Figure 1:
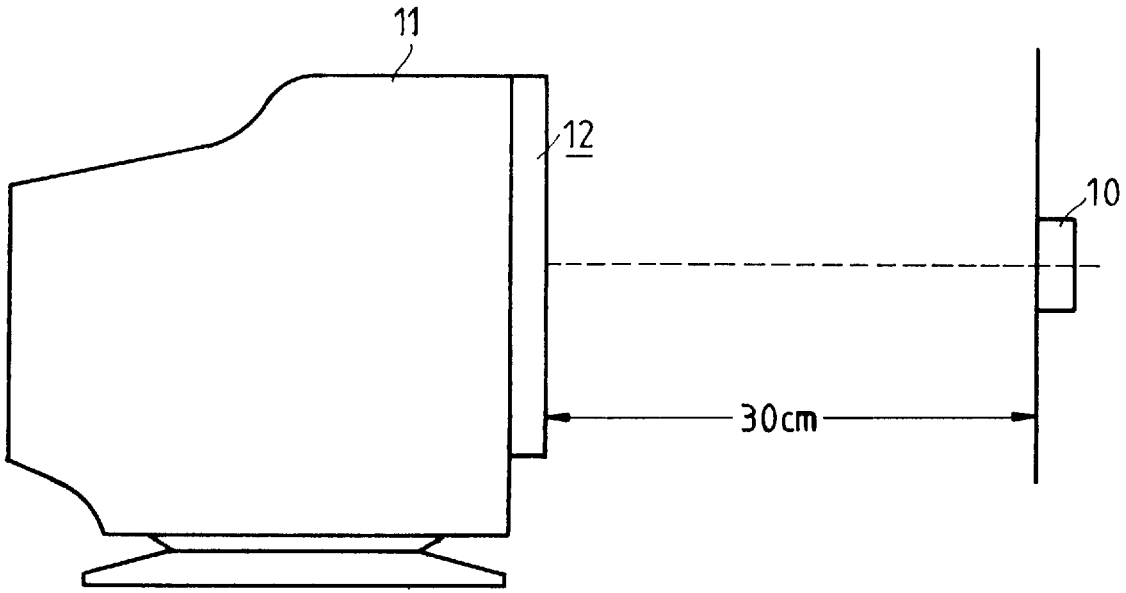
FIG.1 PRIOR ART
FIG. 1 is a schematic view showing a test arrangement in accordance with the TCO regulation.
Figure 3:
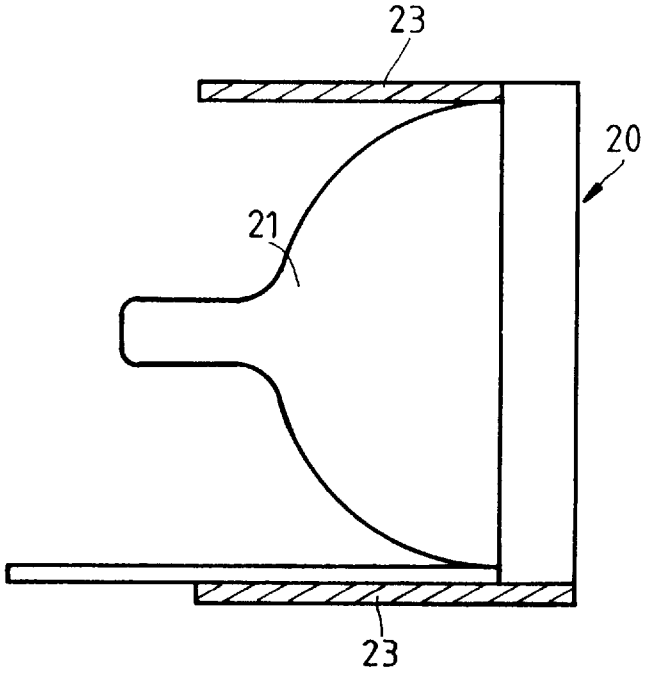
FIG. 3 is a schematic view showing a low frequency radiation eliminating device in accordance with a second embodiment of the present invention.

Alternatively, the second plates 23 may be arranged on the top and bottom sides of the cathode ray tube 21, as shown in FIG. 3.

In both cases, the first plates 22 and the second plates 23 are disposed inside a monitor casing (not shown) that encloses the cathode ray tube 21 so that the overall outside configuration of the monitor is not altered.

Figure 4:
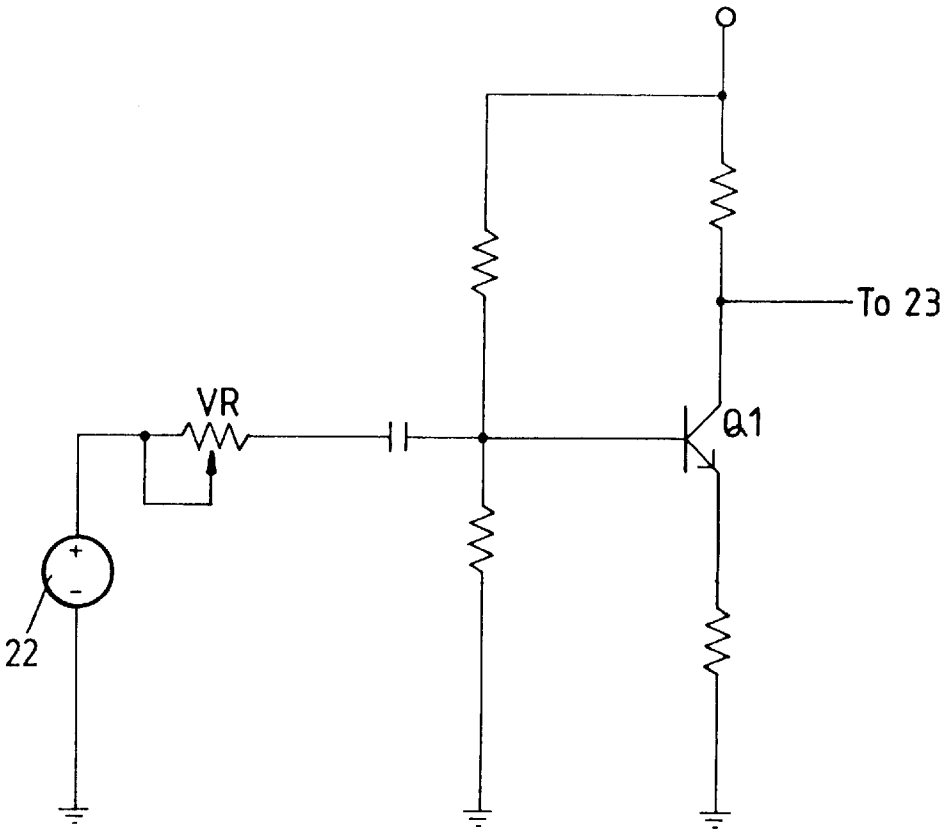
FIG. 4 is a circuit diagram in accordance with the present invention.

With reference to FIG. 4, wherein a circuit for inverting and amplifying the radiation signal induced on the first plates 22 is shown, the circuit comprises an inverting amplifier circuit constituted by a transistor Q1. The radiation signal (of the frequency 64 KHz or 31.5 KHz) induced on the first plates 22 is applied to an input of the circuit and the radiation signal that is applied to the circuit is first sent through a variable resistor (VR) to adjust the amplitude thereof which determines the amplification ratio of the transistor Q1. The emitter of the transistor Q1 constitutes an output terminal of the circuit so that the transistor Q1 amplifies and inverts the input signal from the variable resistor VR and outputs a negative (or inverted) amplified signal relative to the radiation signal from the first plates 22.

The negative output of the circuit is then transmitted to the second plates 23 to cancel the radiation generated by the cathode ray tube 21.

Figure 5:
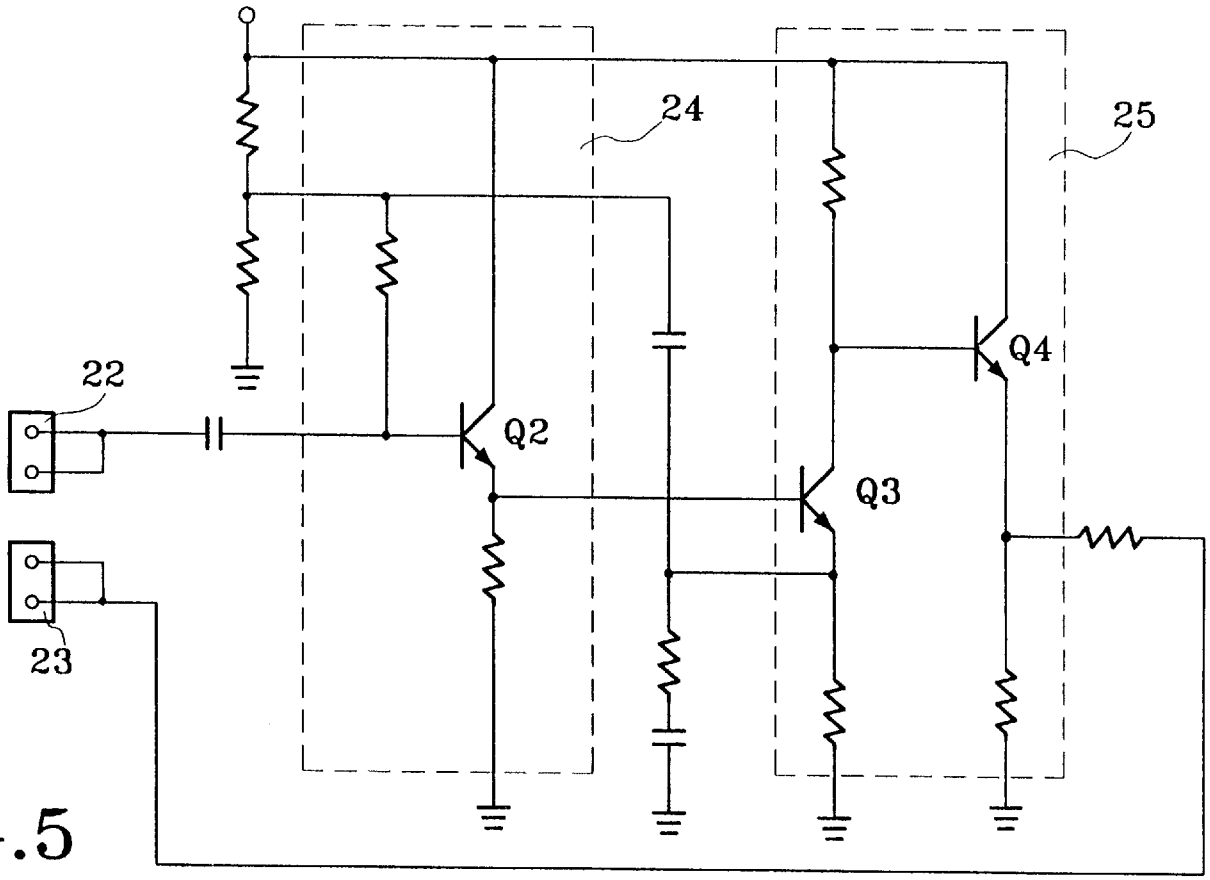
FIG. 5 is another circuit diagram in accordance with the present invention.

Alternatively, as shown in FIG. 5, the circuit may be a high input impedance inverting amplification circuit comprising a buffer 24 and an amplification circuit 25. The buffer 24 is composed of a transistor Q2 which stabilizes the radiation signal received from the first plates 22 and applies the signal to the amplification circuit 25 which then amplifies and inverts the signal. The amplification circuit 25 is composed of transistors Q3 and Q4. The transistor Q3 serves to invert the signal from the transistor Q2, while the transistor Q4 amplifies the inverted signal. The output signal of the transistor Q4 is an inverted and amplified signal of the radiation signal from the first plates 22 and is applied to the second plates 23 to cancel the radiation generated by the cathode ray tube 21.

It is quite apparent that besides the exemplary circuits illustrated in FIGS. 4 and 5, there are many other circuit arrangements which are capable to achieve the same function of amplification and inversion of the radiation signal from the first plates 22 and modifications made on the circuits should be considered within the scope covered by the present invention.

Figure 6:
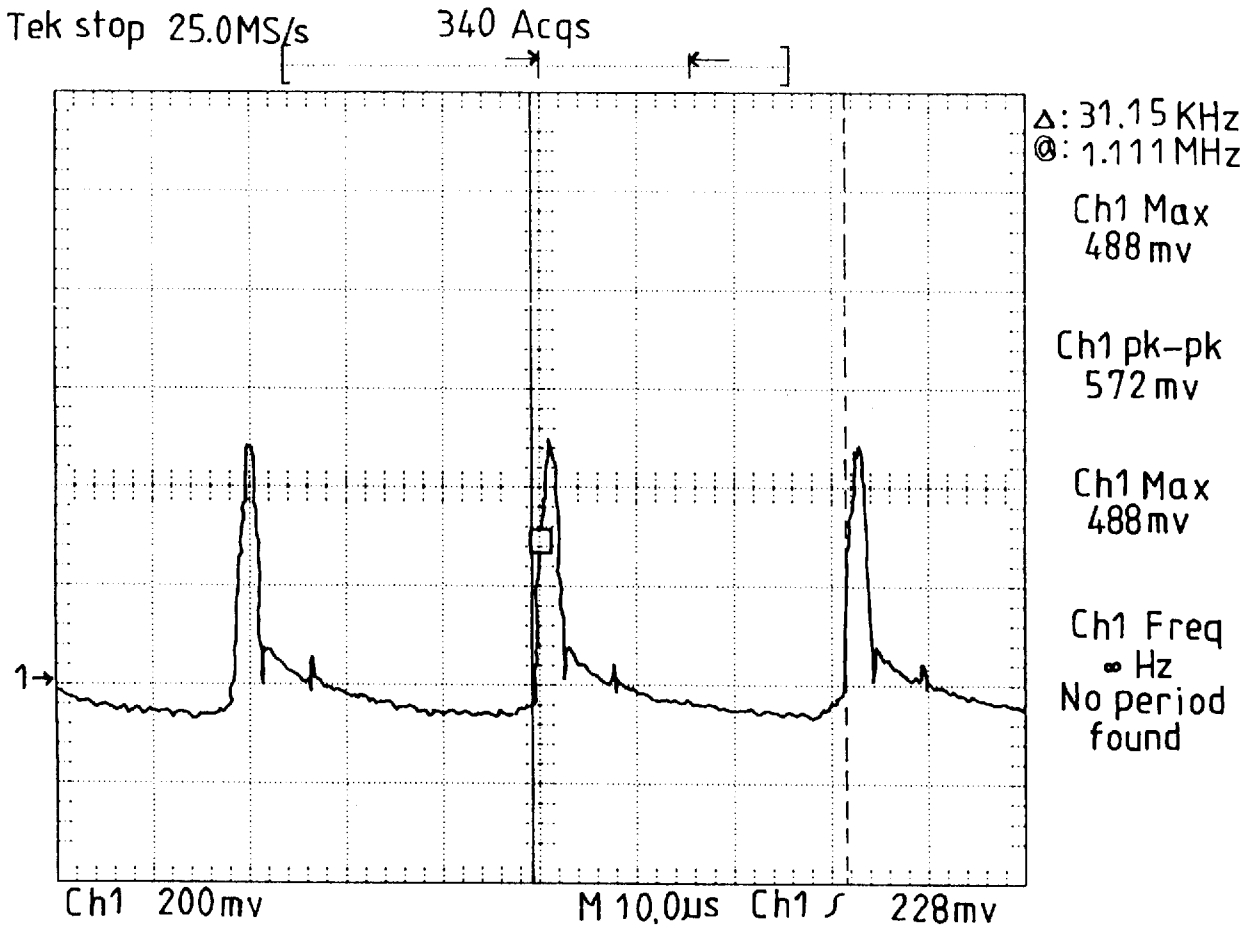
FIG. 6 is a plot demonstrating the radiation signal of 31.5 KHz generated in an operating computer monitor.
Figure 7:
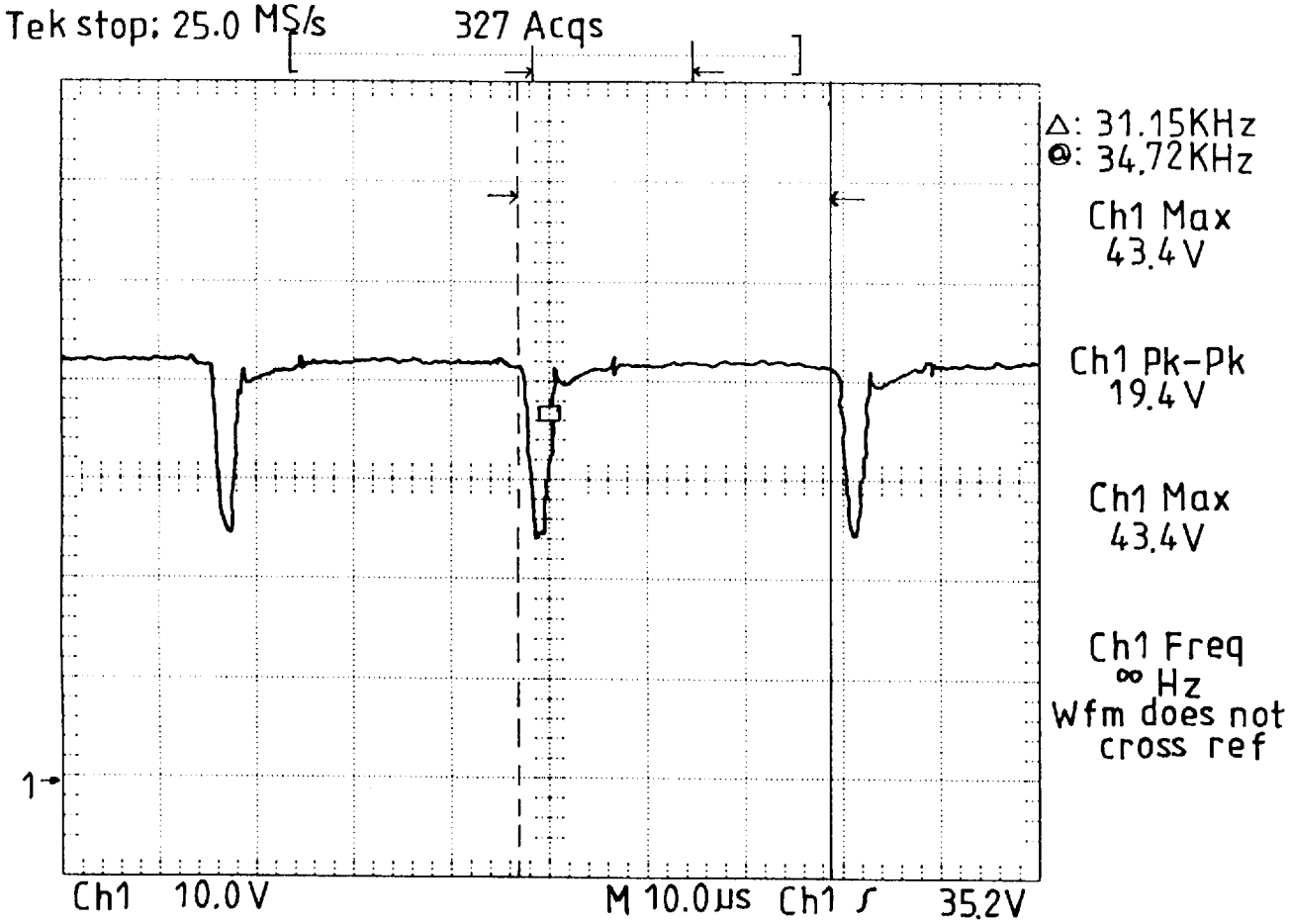
FIG. 7 is a plot showing the output signal of the radiation eliminating device of the present invention in response to the radiation of 31.5 KHz shown in FIG. 6.
Figure 8:
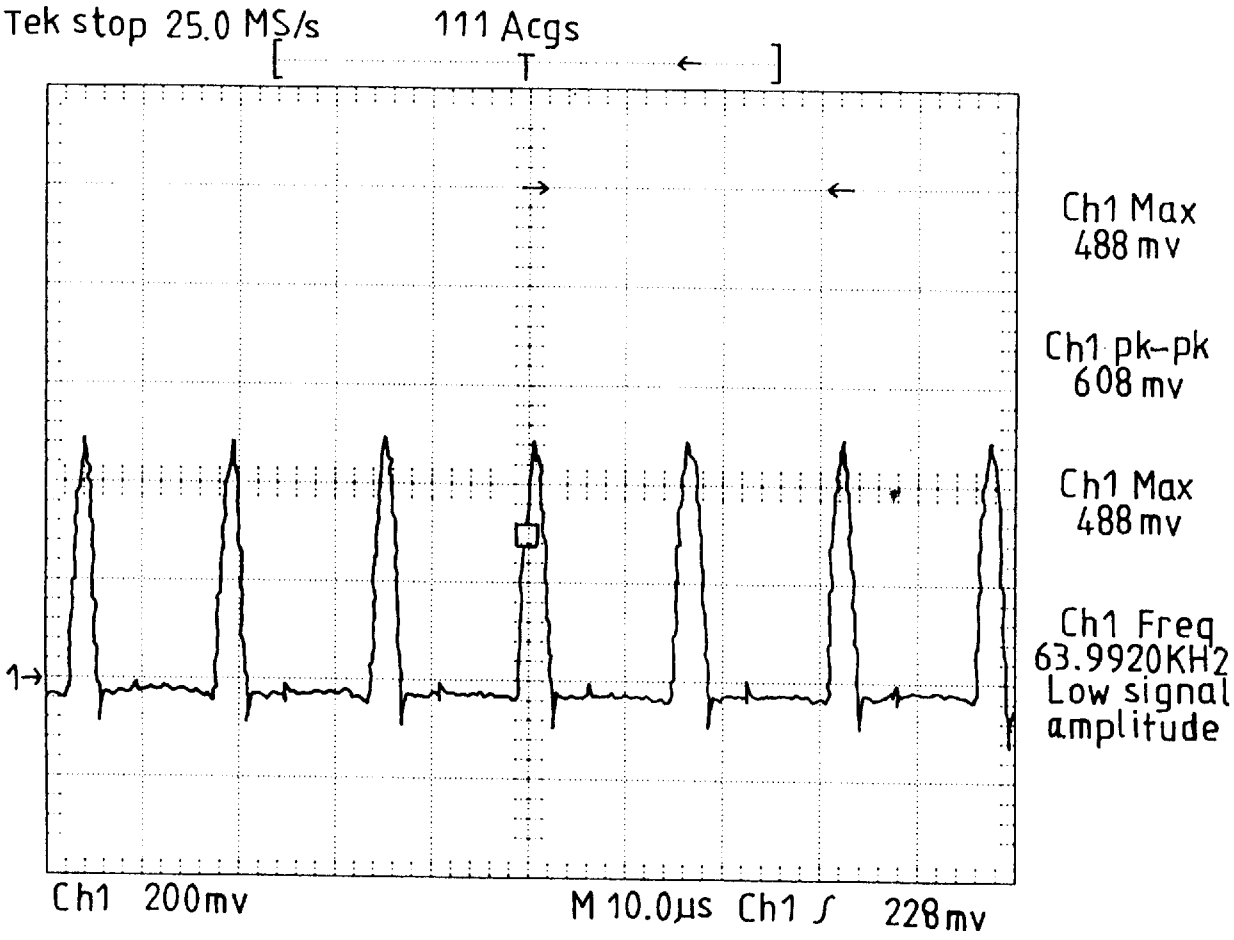
FIG. 8 is a plot demonstrating the radiation signal of 64 KHz generated in an operating computer monitor.
Figure 9:
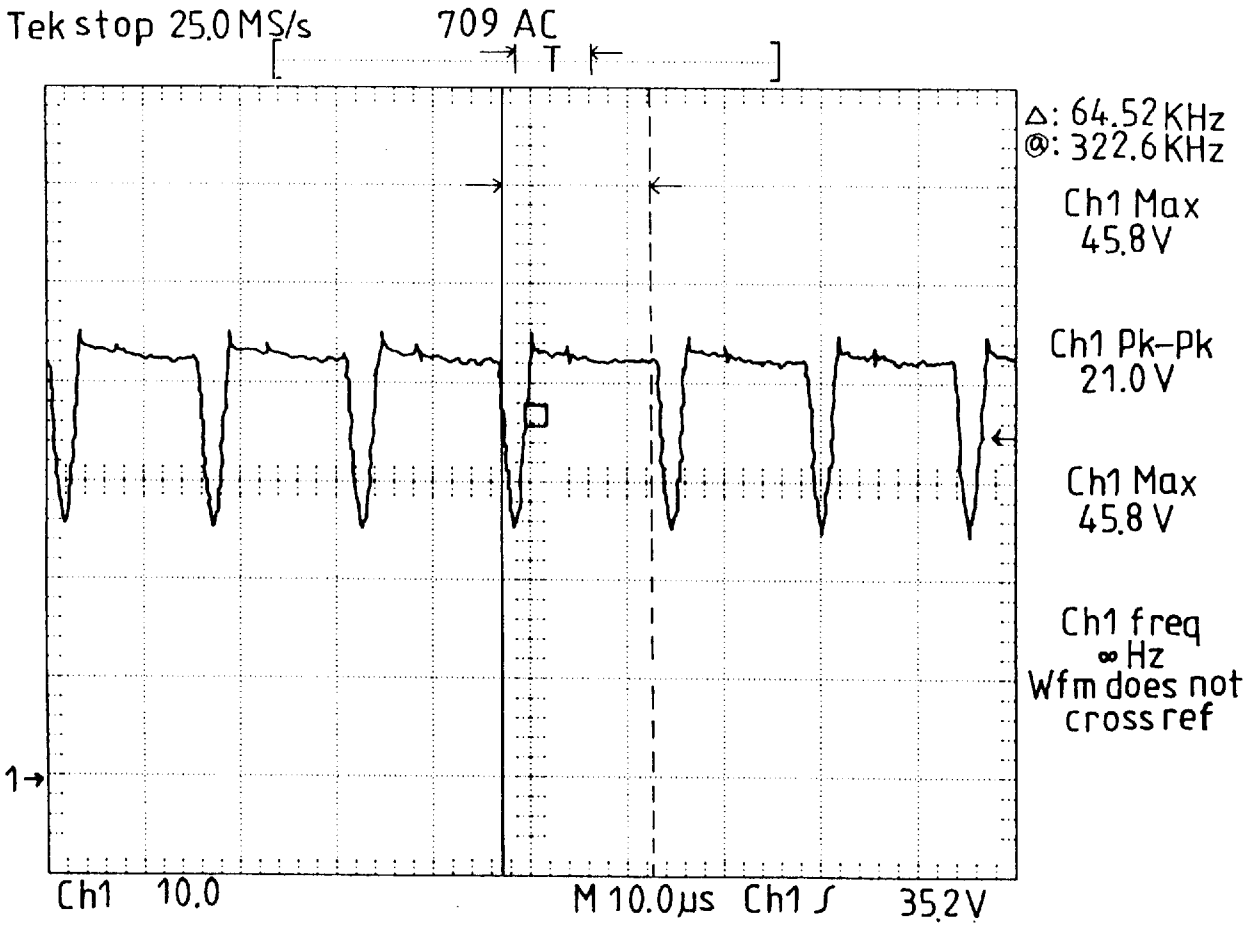
FIG. 9 is a plot showing the output signal of the radiation eliminating device of the present invention in response to the radiation of 64 KHz shown in FIG. 8.

FIG. 6 shows the radiation signal of 31.5 KHz that is generated by the cathode ray tube 21 and induced on the first plates 22. The radiation signal is then amplified and inverted by the circuit of either FIG. 4 or FIG. 5 and then applied to the second plates 23. The inverted and amplified output signal of the circuit is shown in FIG. 7. As is quite apparent by comparing FIGS. 6 and 7, the radiation signal generated by the cathode ray tube 21 can be almost completely canceled or eliminated by the output signal from the circuit. FIG. 8 shows the radiation signal of the frequency of 64 KHz which after being applied to the circuit of either FIG. 4 or FIG. 5 to be inverted and amplified thereby generates an output signal illustrated in FIG. 9. Obviously, the cathode ray tube radiation of 64 KHz may also be almost eliminated by the output signal from the circuit.

Thus, the present invention provides a device to effectively eliminate the low frequency radiation generated by a cathode ray tube without using any low surface impedance cathode ray tube or without treating the cathode ray tube screen with any coating.

Although preferred embodiments are described to illustrate the present invention, it is understood that the present invention is not limited to the specific examples illustrated herein and in the drawings and is only defined by the appended claims as follows.

What is claimed is:

1. A device for eliminating low frequency radiation of a computer monitor wherein the monitor includes a cathode ray tube with a screen having edge portions, the device comprising a pair of first conductive plates disposed on two opposite first ones of the side edge portions of the screen of the cathode ray tube of the monitor to generate a radiation signal on the pair of first plates that is induced by the low frequency radiation of the monitor, a circuit which amplifies and inverts the induced radiation signal to generate an inverted and amplified output signal, a pair of second conductive plates arranged on another two opposite second ones of the side edge portions of the screen of the cathode ray tube and the second plates are connected with the circuit to cancel the low frequency radiation of the cathode ray tube.

2. The device as claimed in claim 1, wherein the conductive plates comprises metal plates made of a metal selected from the group consisting of copper-based alloys and iron-based alloys.

3. The device as claimed in claim 1, wherein the circuit comprises an inverting amplifier.

4. The device as claimed in claim 1, wherein the second plates are smaller in size than the first plates.

5. The device as claimed in claim 1, wherein the first conductive plates are disposed on lateral side edge portions of a screen of the cathode ray tube and the second conductive plates are disposed on top and bottom sides of the cathode ray tube.

* * * * *